US006662721B2

(12) United States Patent
Fujishiro

(10) Patent No.: US 6,662,721 B2
(45) Date of Patent: Dec. 16, 2003

(54) ROTARY PRESS

(75) Inventor: Shinichi Fujishiro, Chiba (JP)

(73) Assignee: Komori Corporation, Tokyo (JP)

( * ) Notice: Subject to any disclaimer, the term of this patent is extended or adjusted under 35 U.S.C. 154(b) by 22 days.

(21) Appl. No.: 09/851,315

(22) Filed: May 9, 2001

(65) Prior Publication Data

US 2001/0047727 A1 Dec. 6, 2001

(30) Foreign Application Priority Data

May 11, 2000 (JP) ..... 2000-138334

(51) Int. Cl.[7] ..... B41F 13/54; B41F 13/24; B41L 39/00; B65H 23/08

(52) U.S. Cl. ..... 101/228; 101/484; 101/232; 101/219; 101/220; 101/221; 101/222; 101/223; 101/224; 226/195; 226/442

(58) Field of Search ..... 101/228, 484, 101/232, 219, 220, 221, 222, 223, 224; 226/195, 442

(56) References Cited

U.S. PATENT DOCUMENTS

| | | | | |
|---|---|---|---|---|
| 5,003,889 A | | 4/1991 | Glunz et al. | |
| 5,996,492 A | * | 12/1999 | Jurkewitz et al. | 101/228 |
| 6,357,349 B1 | * | 3/2002 | Tomberlin et al. | 101/219 |

FOREIGN PATENT DOCUMENTS

| | | | |
|---|---|---|---|
| DE | 542952 C | | 2/1932 |
| DE | 8425540 U | | 2/1987 |
| EP | 0384385 A | | 8/1990 |
| EP | 0416389 A | | 3/1991 |
| JP | 61-144350 A | | 7/1986 |

OTHER PUBLICATIONS

"Druckplattenwechsel—auch ohne Papierbahntrennung," DEUTSCHER DRUCKER, vol. 28, No. 35, Sep. 17, 1992, pp. w8–w11, XP000306697, Ostfildern(Ruit) (without translation).

* cited by examiner

*Primary Examiner*—Stephen R. Funk
*Assistant Examiner*—Marvin P. Crenshaw
(74) *Attorney, Agent, or Firm*—Birch, Stewart, Kolasch & Birch, LLP

(57) ABSTRACT

In a rotary press, a first press roller adapted to retreat during printing and advance during plate changing to contact a web is provided on a travel route of the web between a printing unit and a dryer. A second press roller having the same function as the first press roller is provided on the travel route of the web between air infeed unit and the printing unit. A web presser for pinching the web is provided on the travel route of the web between the infeed unit and the second press roller. With the web being pinched by the web presser, the first press roller and the second press roller can be moved by the web in a retreating direction. After plate changing is completed, the press rollers can smoothly ascend regardless of their pressure, and can promptly and smoothly return to the state before plate changing.

12 Claims, 4 Drawing Sheets

ROTARY PRESS

The entire disclosure of Japanese Patent Application No. 2000-138334 filed on May 11, 2000 including specification, claims, drawings and summary is incorporated herein by reference in its entirety.

BACKGROUND OF THE INVENTION

1. Field of the Invention

This invention relates to a rotary press for printing a web, and more specifically, to a rotary press adapted to prevent entrainment of a web during plate changing.

2. Description of the Related Art

Generally, this type of rotary press is composed of a feeder having a roll comprising a web wound in a roll form, a printing unit having printing cylinders, such as blanket cylinders and plate cylinders, for printing the web fed from the feeder, a dryer for drying the web printed by the printing unit, and a folder for folding the web. When changing a plate in a double-sided four-color printing press having four printing units, for example, the printing press is stopped, and the plate cylinder is rotated by about one turn in normal and reverse directions to remove the old plate from the plate cylinder and mount a new plate on the plate cylinder.

When rotating the plate cylinder in the normal and reverse by about one turn, if an as-printed state is maintained, namely, if the web is kept taut between the feeder and the dryer, a heavy load may be imposed on the web between the printing units and the dryer to cause tearing of the web. To prevent this problem, a connection between a drive on the folder side and a drive on the printing unit side is cut off by a clutch, and the printing cylinder is rotated by almost two turns in the normal direction. By this measure, the web is slackened beforehand between the printing units and the dryer.

Japanese Unexamined Patent Publication No. 165400/1999 discloses a technique which provides a wrap preventing member (press roller, dancer roller) on a web travel route between a printing unit and a folder (and between a feeder and the printing unit), the wrap preventing member being designed to retreat during printing and advance during plate changing to contact the web, so that a slack portion of the web is pressed downward and stretched under a certain tension by the wrap preventing member. According to this technique, the slack portion of the web is prevented from swaying toward the blanket cylinder or the plate cylinder during plate changing and being caught between the plate cylinder and the blanket cylinder positioned below the web.

In the rotary press of the above-described publication, the drive clutch is engaged after completion of plate changing, and the web is discharged toward the folder. However, the pressure of the wrap preventing member during plate changing is so high that the web accumulated at the wrap preventing member on the folder side cannot be discharged. Thus, the pressure of the wrap preventing member was weakened after completion of plate changing so that the web accumulated at the wrap preventing member can be discharged. However, the feed amount of the web fed from the feeder (infeed unit), and the feed amount of the web discharged toward the folder are small. Thus, it takes time to discharge the web accumulated at the wrap preventing member. Depending on the paper quality of the web, etc., moreover, the wrap preventing member still fails to ascend.

SUMMARY OF THE INVENTION

The present invention has been accomplished in consideration of the above problems with the earlier technology. It is the object of the invention to provide a rotary press in which after plate changing is completed, a wrap preventing member can smoothly ascend regardless of its pressure, and can promptly and smoothly return to the state before plate changing.

The present invention, which attains the above object, is a rotary press for printing a web fed from a feeder by a printing unit, comprising a wrap preventing member provided on a travel route for the web downstream from the printing unit, the wrap preventing member being adapted to retreat during printing and advance during plate changing to contact the web, and a pinching member provided on the travel route for the web between the feeder and the printing unit, the pinching member being adapted to support the web in a pinching manner, wherein the wrap preventing member is movable in a retreating direction by the web, with the web being supported in the pinching manner by the pinching member.

According to this aspect, after plate changing is completed, the wrap preventing member can smoothly ascend regardless of its pressure, and can promptly and smoothly return to the state in which it was in before plate changing.

The wrap preventing member may be a press roller, and may be adapted to move upward and downward in accordance with contraction and extension of an air cylinder for the press roller, the air cylinder being mounted so as to face downward.

The air cylinder for the press roller may make a contracting motion when the press roller is detected by a sensor provided at a position at which slackness of the web is small.

The press roller may be locked by a locking mechanism when the air cylinder for the press roller is maximally contracted.

A second wrap preventing member may be provided on the travel route for the web between the feeder and the printing unit and downstream of the pinching member.

The second wrap preventing member may be a second press roller, and may be adapted to move upward and downward in accordance with contraction and extension of an air cylinder for the second press roller, the air cylinder for the second press roller being mounted so as to face downward.

The air cylinder for the second press roller may make a contracting motion when the second press roller is detected by a sensor provided at a position at which slackness of the web is small.

The second press roller may be locked by a second locking mechanism when the air cylinder for the second press roller is maximally contracted.

The pinching member may be composed of a pair of plates, and at least one of the plates may be supported so as to be movable toward and away from the other of the plates.

After the wrap preventing member is brought into an advancing state, the web may be pinched by the pinching member; with a pinched state of the web being kept, plate changing may be performed by normal and reverse rotations of plate cylinders; after plate changing is completed, the wrap preventing member may be retreated by the web, and then the pinched state of the web by the pinching member may be released.

The wrap preventing member may enter into an advancing state after normal rotation of plate cylinders; then, after the plate cylinders are stopped, a second wrap preventing member, provided on the travel route for the web between the feeder and the printing unit and downstream from the pinching member, may be brought into an advancing state; then, with the web being pinched by the pinching member, plate changing may be performed by normal and reverse rotations of the plate cylinders; and after plate changing is completed, the wrap preventing member and the second wrap preventing member may be retreated by the web, and then the pinched state of the web by the pinching member may be released.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE INVENTION

Preferred embodiments of the rotary press according to the present invention will now be described in detail with reference to the accompanying drawings, which in no way limit the invention.

Figure 1:
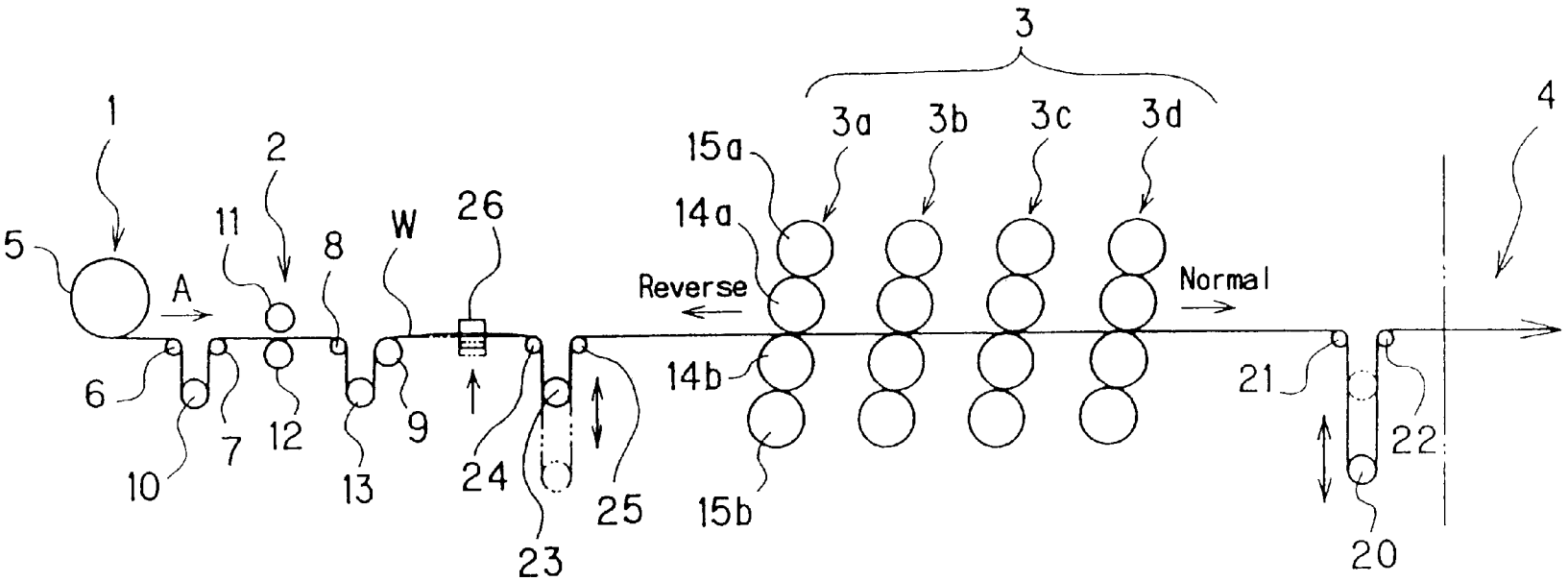
FIG. 1 is a schematic constitutional drawing of a principal part of a rotary press showing an embodiment of the present invention.

As shown in FIG. 1, the rotary press has, in the order of printing, a feeder 1, an infeed unit 2, a printing unit 3 for printing a web W fed from the infeed unit 2, and a dryer 4 for drying the web W printed by the printing unit 3, and also has a cooler for cooling the dried web W, a web path portion, and a folder, although none of the cooler, web path portion, and folder are shown.

In the feeder 1, a roll 5 consisting of the web W wound in a roll form is present together with a spare roll (not shown).

In the infeed unit 2, guide rollers 6, 7, 8, 9 for guiding the web W pulled out of the roll 5 to the printing unit 3 are present. Numeral 10 denotes a tension roller, provided between a pair of guide rollers 6 and 7 arranged in an opposed manner. The tension roller 10 is supported by an air cylinder (not shown) such that the roller 10 freely moves in an upward and downward directions, and is always urged in a downward direction at a constant pressure. Thus, the tension roller 10 prevents slackness of the web W fed from the feeder 1. Numerals 11 and 12 denote a pair of nip rolls. The upper nip roll 11 freely moves in the upward and downward directions by an air cylinder (not shown). During plate changing, the upper nip roll 11 moves downward, and contacts the lower nip roll 12 at a predetermined nip pressure to keep the feed speed of the web W constant. Numeral 13 denotes a constant position control roller, which is provided between a pair of guide rollers 8 and 9 arranged in an opposed manner, and is also located below these rollers 8 and 9 to impart a tension to the web W constantly.

The printing unit 3 has four printing units 3*a*, 3*b*, 3*c*, and 3*d*. Each of these printing units 3*a*, 3*b*, 3*c*, and 3*d* is equipped with a pair of blanket cylinders 14*a* and 14*b* sandwiching the traveling web W, a pair of plate cylinders 15*a* and 15*b* in contact with the blanket cylinders 14*a* and 14*b*, and inking devices and dampeners (not shown) for supplying water and ink to the plate cylinders 15*a* and 15*b*.

In the present embodiment, a first press roller (dancer roller) 20 is provided on a travel route of the web W between the printing unit 3 and the dryer 4, and is located between a pair of guide rollers 21 and 22 arranged in an opposed manner. The first press roller 20 serves as a wrap preventing member adapted to retreat during printing and advance during plate changing to contact the web W. On the travel route of the web W between the infeed unit 2 and the printing unit 3, a second press roller (dancer roller) 23, having the same function as that of the first press roller 20, is provided between a pair of guide rollers 24 and 25 arranged in an opposed manner. On the travel route of the web W between the infeed unit 2 and the second press roller 23, a web presser 26 is provided as a pinching member for supporting the web W in a pinching manner. The first press roller 20 and the second press roller 23 are movable by the web W in a retreating direction, with the web W being supported in a pinched manner by the web presser 26.

Figure 3:
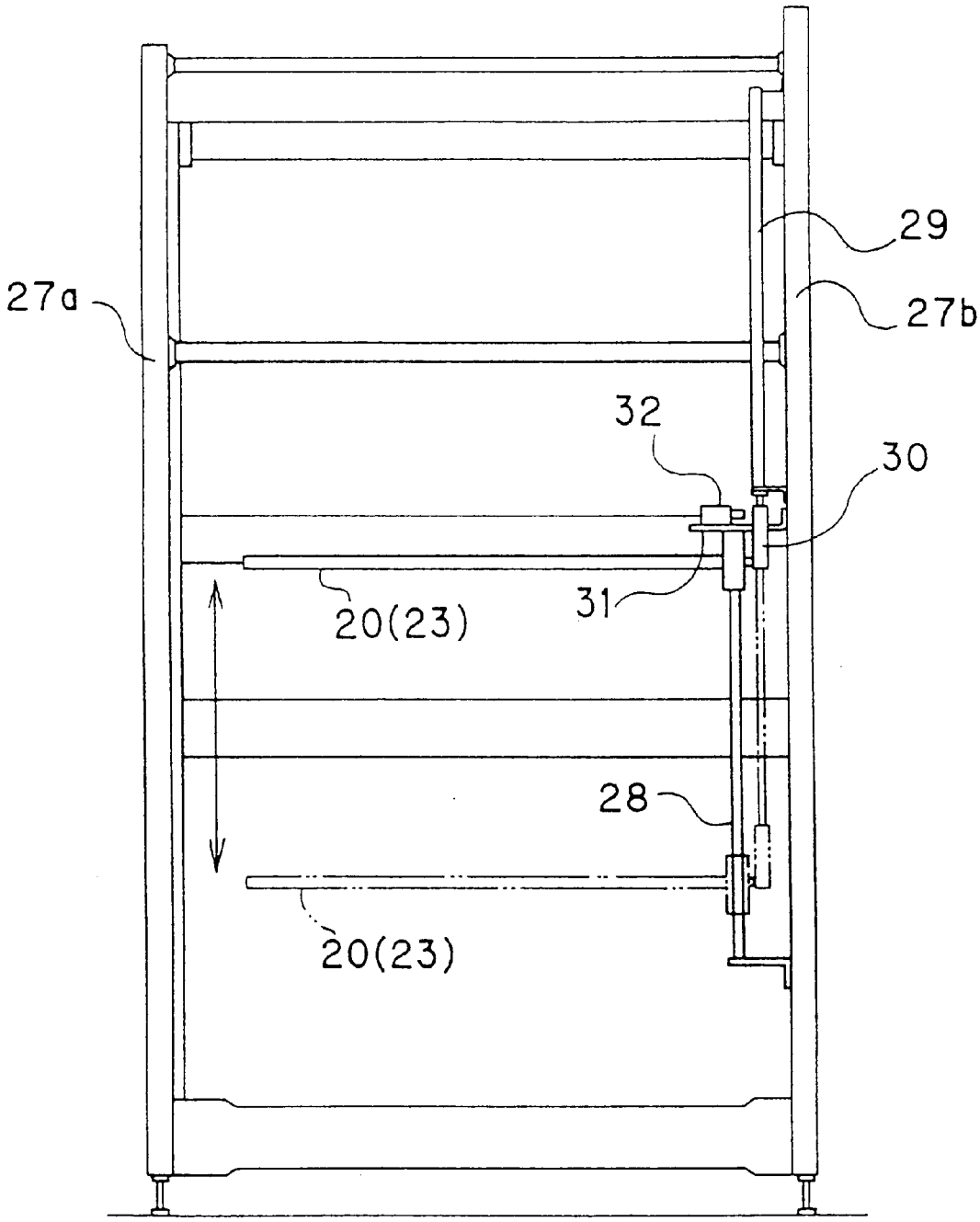
FIG. 3 is an explanatory drawing of a press roller of the rotary press.

As shown in FIG. 3, the first press roller 20 and the second press roller 23 are each adapted to move upward and downward, while being guided by a guide shaft 28, between left and right struts 27*a* and 27*b* as a pair erected on a floor. The upward and downward movements of the press roller 20 or 23 take place in accordance with the contraction and extension of a first air cylinder 29 attached downwardly to the strut 27*b*. During printing, the first press roller 20 and the second press roller 23 are positioned and fixed (locked), in the most contracted state of the first air cylinder 29, namely, at the retreat position of the first press roller 20 and the second press roller 23 (see solid lines in FIG. 3), by a locking mechanism which is not shown. The locking mechanism is constituted between a connecting member 30 connected to the front end of the piston rod of the first air cylinder 29, and the second air cylinder 32 attached laterally to the strut 27*b* via a bracket 31. The second air cylinder 32 functions via a controller, etc. (not shown). That is, the second air cylinder 32 is adapted to act responsive to a detection signal from a proximity sensor (not shown) for detecting the top limit position of the connecting member 30, and extend in the ON-state of the detection signal, thereby performing the aforementioned locking action. The above devices for pressing the web W are constituted in the same manner as the device disclosed in the aforementioned Japanese Unexamined Patent Publication No. 165400/1999. Thus, reference to the relevant disclosure in this publication is requested, and a detailed description of the pressing devices is omitted herein.

Figure 2:
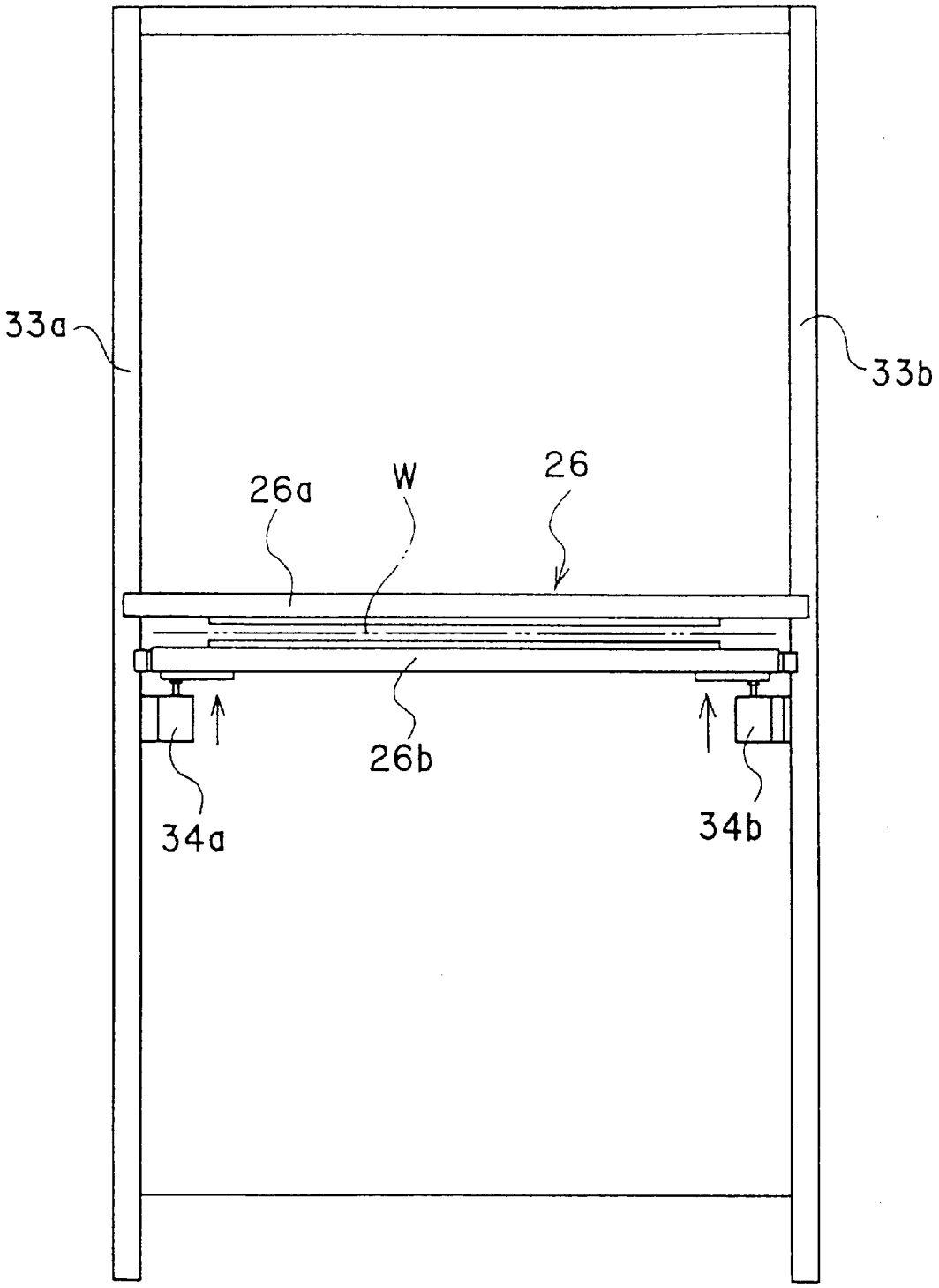
FIG. 2 is an explanatory drawing of a web presser of the rotary press.

The web presser 26, as shown in FIG. 2, is composed of an upper fixed plate 26*a* constructed, like a bridge, between left and right struts 33*a* and 33*b* as a pair erected on the floor, and a lower movable plate 26*b* movable toward and away from the upper fixed plate 26*a*. Front ends of piston rods of third air cylinders 34*a* and 34*b*, attached downwardly to the struts 33*a* and 33*b*, respectively, are connected to left and right end portions of the lower movable plate 26*b*. Upon extension of the third air cylinders 34*a* and 34*b*, the lower movable plate 26*b* approaches the upper fixed plate 26*a* to pinch the web W between the lower movable plate 26*b* and the upper fixed plate 26*a*. Upon contraction of the third air cylinders 34*a* and 34*b*, the lower movable plate 26*b* moves away from the upper fixed plate 26*a* to release the web W. The third air cylinders 34*a* and 34*b* are adapted to act responsive to cylinder phase detection means of the present printing press via a controller, etc. (not shown), and extend at a predetermined time during plate changing (to be described later), thereby performing the above-mentioned pinching action to the web W.

The respective rollers and cylinders, which constitute the aforementioned feeder 1, infeed unit 2, printing unit 3, and dryer 4, are connected by a drive shaft (not shown), and driven by a drive motor of the present printing press provided at a side of the feeder 1. A clutch (not shown) is provided between the printing unit 3 and the folder, and can be engaged or disengaged so as to or not to transmit rotation from the motor for driving the present printing press.

A routine printing operation of the so constituted printing press will be described. First, the nip roll 11 of the infeed unit 2 is in contact with the nip roll 12, and the blanket cylinders 14*a* and 14*b* of the printing units 3*a* to 3*d* are also in contact with each other. The first air cylinder 29 contracts and the press roller 20 and 23 are positioned and fixed at the retreat position shown by the solid lines in FIG. 3. At this time, the second air cylinder 32 extends to make a locking motion. Thus, the press rollers 20, 23 do not advance to the travel route for the web W. The third air cylinders 34*a*, 34*b* contract, so that the pinching member 26 does not perform a pinching action. When a button for print start is pushed in this state, the respective rollers and cylinders rotate in the normal direction. The web W pulled out of the roll 5 travels in the direction of an arrow A along the guide roller 6, tension roller 10, guide roller 7, nip rolls 11, 12, guide roller 8, constant position control roller 13, and guide roller 9, and is fed to the printing unit 3. Even if slackness occurs, at this time, in the web W withdrawn from the roll 5, the slackness is eliminated by the tension roller 10. The feed speed of the web W is always kept constant by the nip rolls 11, 12. The web W fed to the printing unit 3 is printed, on its face side and back side, in four colors by means of the four printing units 3*a* to 3*d*. Then, the web W is introduced into the dryer 4 to have the printed surfaces dried.

Figure 4:
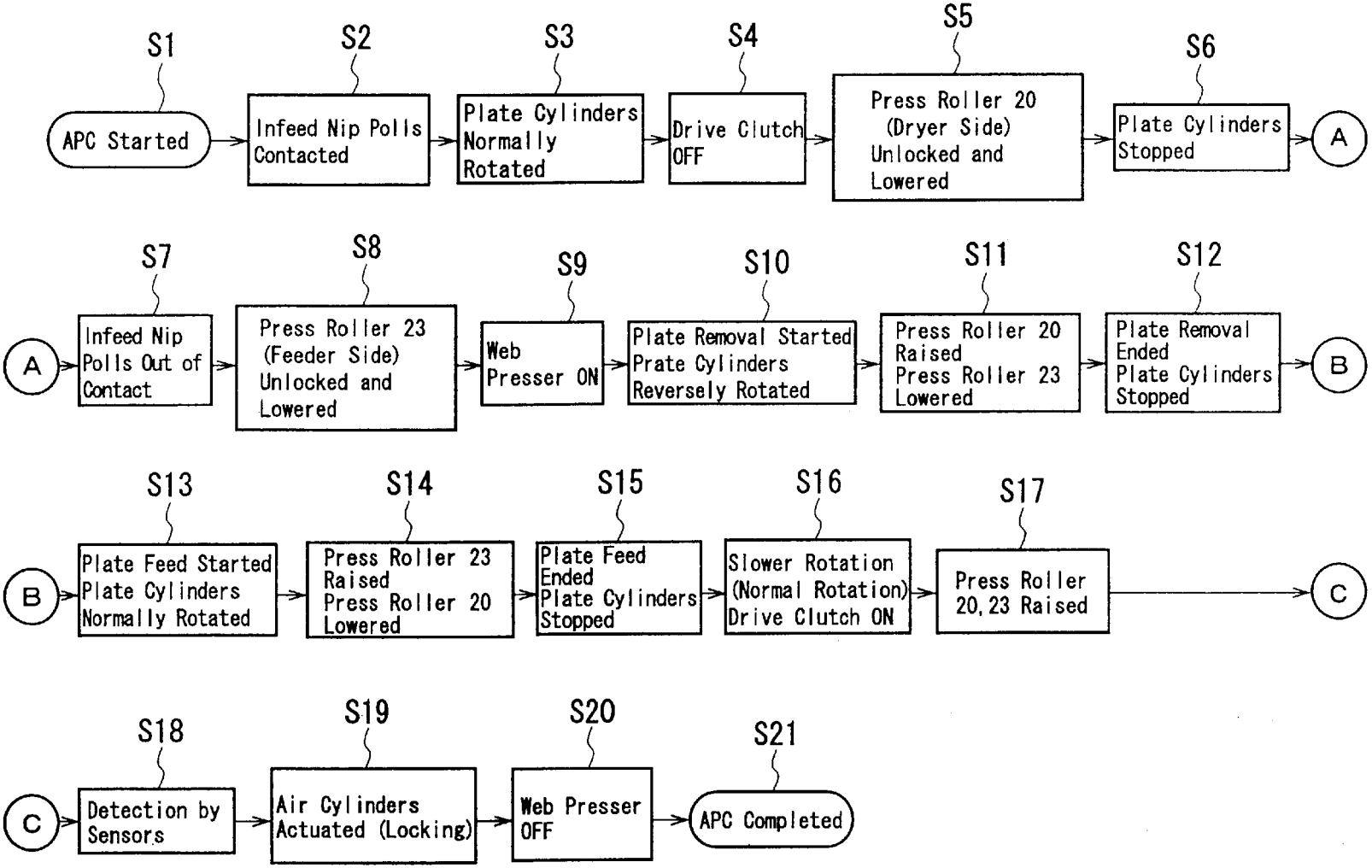
FIG. 4 is a process chart showing the order of actions in the rotary press.

Next, a plate changing operation will be described based on FIG. 4. When a start button for plate changing (automatic plate changer) is pushed in S1, the nip roll 11 comes into contact with the nip roll 12 in S2. In S3, after the contacted blanket cylinders 14*a*, 14*b* of the respective printing units 3*a* to 3*d* are brought out of contact, the drive motor for the printing press is driven to rotate the plate cylinders 15*a*, 15*b* of the printing unit 3 by about two turns in the normal direction. At the same time, the clutch for connecting drive for the printing unit 3 to drive on the folder side is disengaged in S4. At this time, a slack portion corresponding to nearly the outer periphery of the plate cylinder 15*a* occurs in the web W located between the printing unit 3 and the dryer 4. In S5, the second air cylinder 32 is contracted to release from the locked state, and then the first air cylinder 29 is extended to lower the first press roller 20, whereby the slackness of the web W is removed. In S6, the plate cylinders 15*a*, 15*b* are stopped. Then, the nip rolls 11, 12 are brought out of contact in S7. If the nip rolls 11, 12 are actuated in an attempt to make the tension of the web W constant during plate changing, the web W may be torn. The step S7 is performed to exclude the possibility of this web tearing. In S8, the second air cylinder 32 is contracted to release the locked state, and then the first air cylinder 29 is extended to lower the second press roller 20 slightly. In S9, the third air cylinders 34*a*, 34*b* are extended to pinch the web W by the web presser 26. In S10, plate removal starts, the plate cylinders 15*a*, 15*b* of the printing unit 3 rotate by about one turn in the reverse direction, and the old plate from the plate cylinders 15*a*, 15*b* is removed. At this time, the web W travels in the direction opposite to the direction of the arrow A. Thus, in S11, the first press roller 20 ascends upon contraction of the first air cylinder 29, while the second press roller 23 descends upon extension of the first air cylinder 29. Thus, although the amount of slackness of the web W increases between the infeed unit 2 and the printing unit 3, this slackness is eliminated, because the web W is pressed downward by the second press roller 23. In S12, plate removal ends, and the rotation of the plate cylinders 15*a*, 15*b* stops. Then, in S13, plate supply starts, the plate cylinders 15*a*, 15*b* rotate by about one turn in the normal direction, and anew plate on the plate cylinders 15*a*, 15*b* is mounted. At this time, the web W travels in the direction of the arrow A. Thus, in S14, the first press roller 20 descends upon extension of the first air cylinder 29, while the second press roller 23 ascends upon contraction of the first air cylinder 29. Thus, although the amount of slackness of the web W increases between the printing unit 3 and the dryer 4, this slackness is eliminated, because the web W is pressed downward by the first press roller 20.

As described above, the first and second press rollers 20 and 23 move upward and downward in the opposite directions, so that tearing of the web W ahead of or behind the printing unit 3 can be prevented. The occurrence of slackness is also prevented, so that a slack portion of the web W is not caught by the plate cylinder 15*b* or blanket cylinder 14*b* during a plate changing operation. Furthermore, the second press roller 23 is provided between the infeed unit 2 and the printing unit 3, thus making it possible to deal with voluntary amount of slackness occurring between the infeed unit 2 and the printing unit 3.

In S15, plate supply ends, and the rotation of the plate cylinders 15*a*, 15*b* stops. Then, in S16, the printing press is rotated at a slower speed, and the clutch connecting drive for the printing unit 3 and drive for the folder is engaged. Upon engagement of the clutch, the web W travels in the direction of the arrow A, and thus the press rollers 20, 23 ascend in S17. At this time, the web W is pinched by the web presser 26 at an upstream of the second press roller 23, whereby the feed of the web W from the infeed unit 2 is cut off. Thus, the first press roller 20 on the folder side involving a large amount of slackness, in particular, ascends smoothly regardless of the pressure of the first air cylinder 29. In S18, the ascent position of the press rollers 20, 23 is detected by the proximity sensors (not shown). The position of detection by the proximity sensors is a position at which the slackness of the web W is small. Upon this detection, the first air cylinder 29 is contracted maximally in S19 to return the press rollers 20, 23 to the retreat position. At the same time, the second air cylinder 32 extends to lock the press rollers 20, 23 at the retreat position. In S20, the third air cylinders 34*a*, 34*b* are contracted to release the web W from the pinching member 26. In S21, the plate changing operation is completed.

While the present invention has been described in the foregoing fashion, it is to be understood that the invention is not limited thereby, but may be varied in many other ways. For example, the first air cylinder 29 may be placed below the web W so as to face upward, and may be extended to bring the press rollers 20, 23 upward. Moreover, the third air cylinders 34*a*, 34*b* may be arranged above the web W so as to face downward, and may be extended to pinch the web W by the pinching member 26. Furthermore, the press rollers 20, 23 and the web presser 26 (upper fixed plate 26*a*, lower movable plate 26*b*) need not be elongated continuously in the axial direction, but may be divided into a plurality of parts in the axial direction. Such variations are not to be regarded as a departure from the spirit and scope of the invention, and all such modifications as would be obvious to one skilled in the art are intended to be included within the scope of the appended claims.

What is claimed is:

1. A rotary press for printing a web fed from a feeder by a printing unit, comprising:

a first wrap preventing member provided on a travel route of the web at a downstream of said printing unit, said first wrap preventing member being adapted to retreat during printing and advance during plate changing to contact the web; and a pinching member provided on the travel route of the web between said feeder and said printing unit, said pinching member being adapted to pinch the web, so that while the web is being pinched by the pinching member, supply of the web from the feeder is shut off;

wherein said first wrap preventing member is movable in a retreating direction by the web, when the web is being pinched by said pinching member.

2. The rotary press of claim 1, wherein said first wrap preventing member includes a first press roller and an air cylinder for said press roller being mounted to face downward, and wherein said press roller is adapted to move upward and downward in accordance with contraction and extension of said air cylinder.

3. The rotary press of claim 2, wherein said first wrap preventing member includes a first sensor provided at a position at which slackness of the web is minimized, and said air cylinder for said first press roller makes a contracting motion when said first sensor detects said first press roller.

4. The rotary press of claim 3, wherein said first wrap preventing member includes a first locking mechanism, and wherein said press roller is locked by said first locking mechanism when said air cylinder for said first press roller is maximally contracted.

5. The rotary press of claim 1, further comprising:

a second wrap preventing member provided on the travel route of the web between said feeder and said printing unit and downstream of said pinching member.

6. The rotary press of claim 5, wherein said second wrap preventing member is a second press roller, and is adapted to move upward and downward in accordance with contraction and extension of an air cylinder for said second press roller, said air cylinder for said second press roller being mounted so as to face downward.

7. The rotary press of claim 6, wherein said second wrap preventing member includes a second sensor provided at a position at which slackness of the web is minimized, and said air cylinder for said second press roller makes a contracting motion when said second sensor detects said second press roll.

8. The rotary press of claim 7, wherein said second wrap preventing member includes a second locking mechanism, and wherein said second press roller is locked by said second locking mechanism when said air cylinder for said second press roller is maximally contracted.

9. The rotary press of claim 1, wherein after said first wrap preventing member is brought into an advancing state, the web is pinched by said pinching member, plate cylinders providing means for plate changing while the web is being pinched by said pinching member, by normal and reverse rotations of plate cylinders, and after plate changing is completed, said first wrap preventing member is retreated by the web, and then a pinching state of the web by said pinching member is released.

10. The rotary press of claim 1, further including plate cylinder means for normal rotation of the plate cylinders so that said first wrap preventing member enters into an advancing state after the normal rotation of plate cylinders, then after said plate cylinders are stopped, a second wrap preventing member, provided on the travel route of the web between said feeder and said printing unit and downstream of said pinching member is brought into an advancing state, then, while the web is being pinched by said pinching member, plate changing is performed by normal and reverse rotations of said plate cylinders, and after plate changing is completed, said first wrap preventing member and said second wrap preventing member are retreated by the web, and then a pinching state of the web by said pinching member is released.

11. A rotary press for printing a web fed from a feeder by a printing unit, comprising:

a first wrap preventing member provided on a travel route of the web at a downstream of said printing unit, said first wrap preventing member being adapted to retreat during printing and advance during plate changing to contact the web; and a pinching member provided on the travel route of the web between said feeder and said printing unit, said pinching member being adpated to pinch the web, wherein said first wrap preventing member is movable in a retreating direction by the web, when the web is being pinched by said pinching member;

said pinching member is composed of a pair of plates, and at least one of said plates is supported so as to be movable toward and away from the other of said plates.

12. A rotary press or printing a web fed from a feeder by a printing unit, comprising:

a first wrap preventing member located on a travel route of the web downstream of said printing unit;

means for retreating during printing and advancing during plate changing to contact the web and, providing means for pinching the web so that while the web is pinched by the pinching member, the web from the feeder is stopped.

* * * * *